US007866538B2

(12) United States Patent
Liao et al.

(10) Patent No.: US 7,866,538 B2
(45) Date of Patent: Jan. 11, 2011

(54) CONTAINER BOX

(75) Inventors: Yu-Chieh Liao, Taipei Hsien (TW); Chun-Hua Wang, Taipei Hsien (TW); Un-Chi Show, Taipei Hsien (TW); Chih-Chien Tsai, Taipei Hsien (TW); Chau-Lin Chang, Taipei Hsien (TW)

(73) Assignee: Foxnum Technology Co., Ltd., Tucheng, Taipei County (TW)

( * ) Notice: Subject to any disclaimer, the term of this patent is extended or adjusted under 35 U.S.C. 154(b) by 200 days.

(21) Appl. No.: 12/171,417

(22) Filed: Jul. 11, 2008

(65) Prior Publication Data

US 2009/0242618 A1 Oct. 1, 2009

(30) Foreign Application Priority Data

Mar. 31, 2008 (CN) ..... 2008 1 0300802

(51) Int. Cl.
*B65D 5/355* (2006.01)

(52) U.S. Cl. ..... 229/101; 229/115; 229/123; 229/186

(58) Field of Classification Search ..... 299/101, 299/114, 115, 123, 186, 928
See application file for complete search history.

(56) References Cited

U.S. PATENT DOCUMENTS

| | | | | | |
|---|---|---|---|---|---|
| 1,833,974 | A | * | 12/1931 | Powell et al. | 229/104 |
| 1,891,876 | A | * | 12/1932 | Everson | 229/114 |
| 1,950,111 | A | * | 3/1934 | Heim | 229/114 |
| 2,156,250 | A | * | 4/1939 | Ziemmerman | 229/114 |
| 2,355,233 | A | * | 8/1944 | Newton | 229/186 |
| 2,572,610 | A | * | 10/1951 | Gilbert | 229/126 |
| 3,119,494 | A | * | 1/1964 | Rosenstiel | 229/103 |
| 3,627,541 | A | * | 12/1971 | Farquhar | 229/186 |
| 3,695,508 | A | * | 10/1972 | Hocking | 229/101 |
| 3,833,113 | A | * | 9/1974 | Osier | 229/186 |
| 5,307,986 | A | * | 5/1994 | Schuster | 229/186 |
| 5,484,100 | A | * | 1/1996 | Rigby | 229/114 |
| 5,495,727 | A | * | 3/1996 | Strong et al. | 229/101 |
| 6,523,738 | B1 | * | 2/2003 | Sarne et al. | 229/101 |

* cited by examiner

*Primary Examiner*—Gary E Elkins
(74) *Attorney, Agent, or Firm*—D. Austin Bonderer

(57) ABSTRACT

An apparatus includes container. The container includes a polygonal bottom panel comprising of N sides, N sidewalls and N flaps. Each flap is located between two adjacent sidewalls. The flaps are capable of unfolding to increase the volume of the container. N is a positive integer greater than two.

20 Claims, 8 Drawing Sheets

CONTAINER BOX

BACKGROUND

1. Field of the Invention

The present invention relates to container boxes.

2. Description of related art

A regular container box includes a bottom, and an opening corresponding to the bottom. The bottom and the opening are usually the same size. When putting an article in or taking it out of the container box, if it is a tight fit, friction between the article and the container box may damage the article.

DETAILED DESCRIPTION OF THE INVENTION

Figure 1:
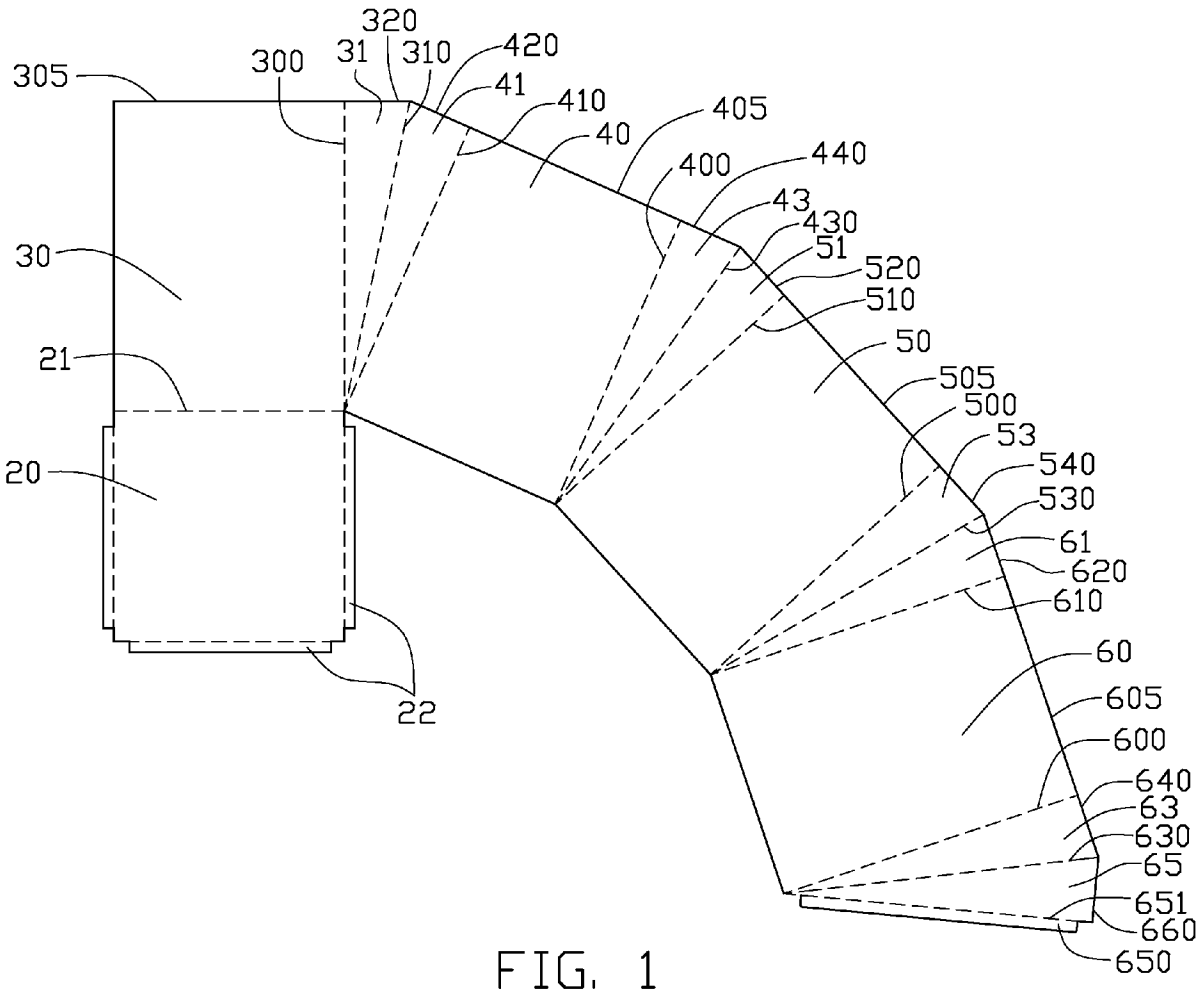
FIG. 1 is a planar view of a container box expanded out according to a first embodiment.

In an embodiment of the invention, a container box (see FIGS. 2 and 3) includes a main body 10 folded from a cardboard (see FIG. 1).

Referring to FIG. 1, the cardboard includes a square bottom panel 20 having four edges, a side panel connected to an edge 21 of the bottom panel 20, and three bottom flanges 22 connected to the other three edges of the bottom panel 20 correspondingly. Creases are defined along the four edges respectively.

The side panel includes a rectangular first sidewall 30 connected to the edge 21 of the bottom panel 20. The first sidewall 30 includes a first longer edge, a second longer edge, and a shorter edge 305. A right-angle triangular first foldable flap 31 is connected to the second longer edge of the first sidewall 30. The first foldable wall 31 includes a hypotenuse edge 310, a shorter edge 320, and a longer edge 300. The shorter edge 320 is aligned with the shorter edge 305 of the first sidewall 30 and the longer edge 300 is superposed with the second longer edge of the first sidewall 30. A right-angle triangular second foldable wall 41 is connected to the hypotenuse edge 310 of the first foldable wall 31. The second foldable wall 41 includes a longer edge 410, a shorter edge 420, and a hypotenuse edge. The hypotenuse edge is superposed with the hypotenuse edge 310 of the first foldable wall 31.

A rectangular second sidewall 40 is connected to the longer edge 410 of the second foldable wall 41. The second sidewall 40 includes a first longer edge, a second longer edge, and a shorter edge 405. The first longer edge is superposed with the longer edge 410 of the second foldable wall 41. The shorter edge 405 is aligned with the shorter edge 420 of the second foldable wall 41. A right-angle triangular third foldable wall 43 is connected to the second longer edge of the second sidewall 40. The third foldable wall 43 includes a longer edge 400, a shorter edge 440, and a hypotenuse edge 430. The longer edge 400 is superposed with the second longer edge of the second sidewall 40 and the shorter edge 440 is aligned with the shorter edge 405 of the second sidewall 40. A right-angle triangular fourth foldable wall 51 is connected to the hypotenuse edge 430 of the third foldable wall 43. The fourth foldable wall 51 includes a hypotenuse edge, a shorter edge 520, and a longer edge 510. The hypotenuse edge is superposed with the hypotenuse edge 430 of the third foldable wall 43.

A rectangular third sidewall 50 is connected to the longer edge 510 of the fourth foldable wall 51. The third sidewall 50 includes a first longer edge, a second longer edge, and a shorter edge 505. The first longer edge is superposed with the longer edge 510 of the fourth foldable wall 51. The shorter edge 505 is aligned with the shorter edge 520 of the fourth foldable wall 51. A right-angle triangular fifth foldable wall 53 is connected to the second longer edge of the third sidewall 50. The fifth foldable wall 53 includes a longer edge 500, a shorter edge 540, and a hypotenuse edge 530; the longer edge 500 is superposed with the second longer edge of the third sidewall 50. The shorter edge 540 is aligned with the shorter edge 505 of the third sidewall 50. A right-angle triangular sixth foldable wall 61 is connected to the hypotenuse edge 530 of the fifth foldable wall 53. The sixth foldable wall 61 includes a hypotenuse edge, a shorter edge 620, and a longer edge 610. The hypotenuse edge is superposed with the hypotenuse edge 530 of the fifth foldable wall 53.

A rectangular fourth sidewall 60 is connected to the longer edge 610 of the sixth foldable wall 61. The fourth sidewall 60 includes a first longer edge, a second longer edge, and a shorter edge 605. The first longer edge is superposed with the longer edge 610 of the sixth foldable wall 61. The shorter edge 605 is aligned with the shorter edge 620 of the sixth foldable wall 61. A right-angle triangular seventh foldable wall 63 is connected to the second longer edge of the fourth sidewall 60. The seventh foldable wall 63 includes a longer edge 600, a shorter edge 640, and a hypotenuse edge 630. The longer edge 600 is superposed with the second longer edge of the fourth sidewall 60. The shorter edge 640 is aligned with the shorter edge 605 of the fourth sidewall 60. A right-angle triangular eighth foldable wall 65 is connected to the hypotenuse edge 630 of the seventh foldable wall 63. The eighth foldable wall 65 includes a hypotenuse edge, a shorter edge 660, and a longer edge 651. The hypotenuse edge is superposed with the hypotenuse edge 630 of the seventh foldable wall 63. A side flange 650 is connected to the longer edge 651 of the eighth foldable wall 65.

Creases are defined along the edges 300, 310, 410, 400, 430, 510, 500, 530, 610, 600, 630, and 651 respectively. The first and second foldable walls 31, 41 make up of a first foldable flap, the third and fourth foldable walls 43, 51 make up of a second foldable flap, the fifth and sixth foldable walls 53, 61 make up of a third foldable flap, and the seventh and eighth foldable walls 63, 65 make up of a fourth foldable flap.

Figure 3:
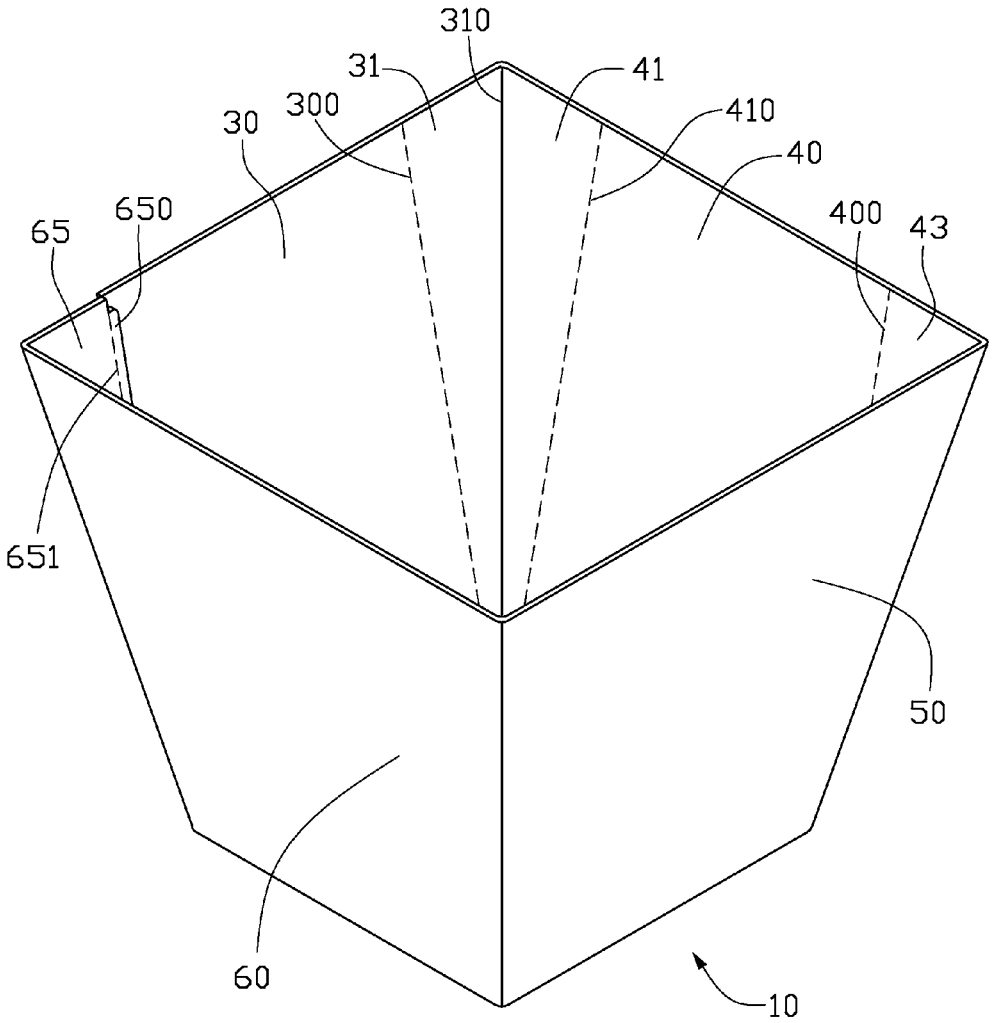
FIG. 3 is another isometric view of the container box of FIG. 1.

To fold the cardboard into the container box, referring to FIGS. 1 and 3, the second foldable wall 41 is folded perpendicularly to the first foldable wall 31 along the crease corresponding to the hypotenuse edge 310. The fourth foldable wall 51 is folded perpendicularly to the third foldable wall 43 along the crease corresponding to the hypotenuse edge 430. The sixth foldable wall 61 is folded perpendicularly to the fifth foldable wall 53 along the crease corresponding to the hypotenuse edge 530. The eighth foldable wall 65 is folded perpendicularly to the seventh foldable wall 63 along the crease corresponding to the hypotenuse edge 630. Each of the bottom flanges 22 is folded perpendicularly to the bottom panel 20 along the corresponding creases. The first sidewall 30 of the side panel is folded perpendicularly to the bottom panel 20 along the crease corresponding to the edge 21. The bottom flanges 22 are attached to the lower edge of the inside surface of the corresponding rectangular sidewalls 40, 50 and 60 by adhesives, staples or any other suitable means. The side flange 650 is attached to the first longer edge by adhesives or staples. Thus, the side panel, and the bottom panel 20 cooperatively form the main body 10 defining an opening that is larger than the bottom thereof.

Figure 2:
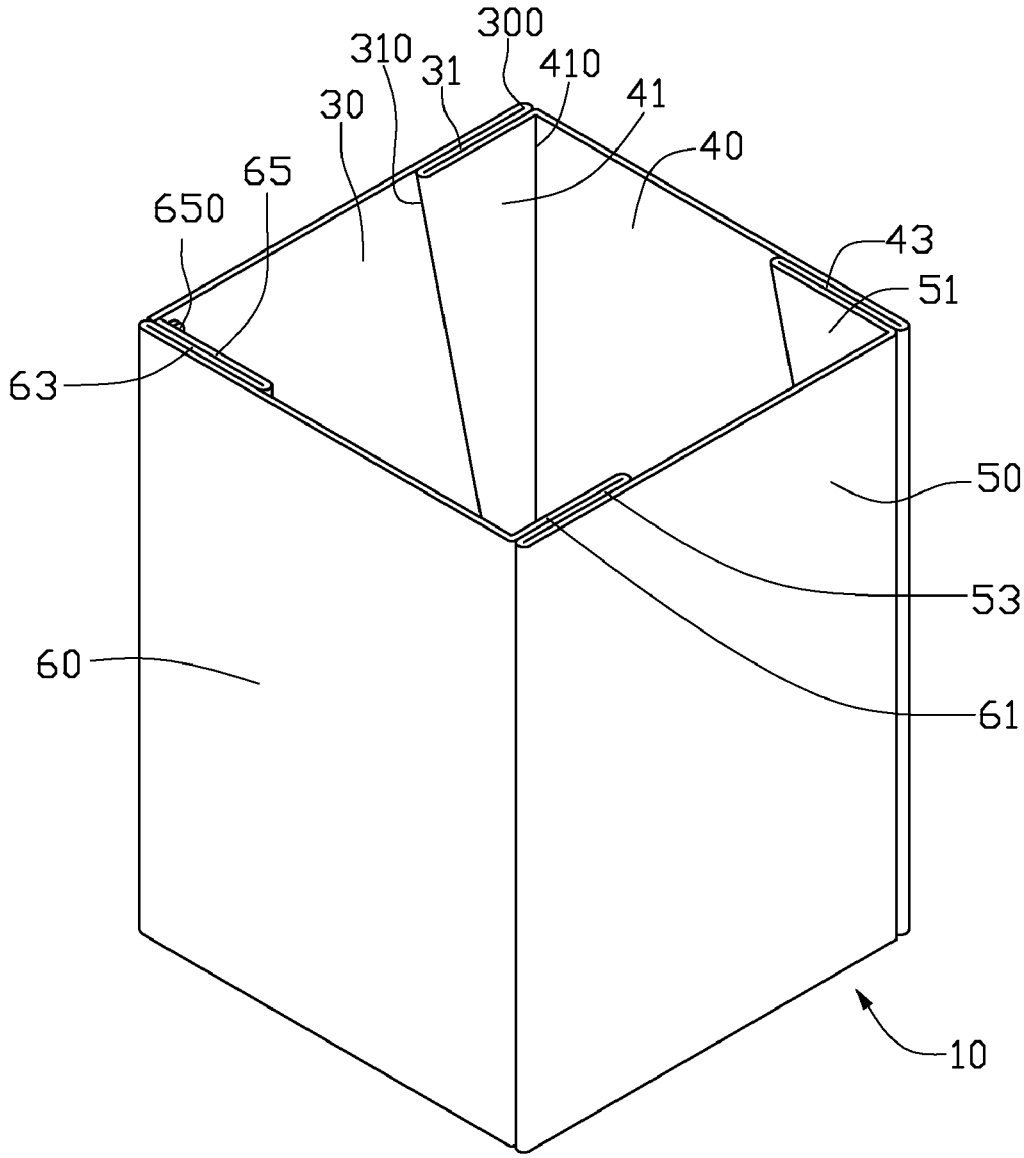
FIG. 2 is an isometric view of the container box of FIG. 1

Referring also to FIG. 2, in use, each of the first, the second, the third and the fourth foldable flaps is inverted inwards into the main body 10. To more clearly describe the embodiment, only the first foldable flap is described as an example. The edge 310 is pushed inwards into the 10 until an outer surface of the first foldable wall 31 and the outer surface of the second foldable wall 41 is folded against each other along the edge 310, thereby forming an inverted folded flap extending inwards. The inverted folded flap is then folded against either of the adjacent sidewalls 30, 40. The same is performed on each foldable flap. As a result, the opening would be equal to the bottom. An article is then disposed in the main body 10. A cap is then disposed on top of the opening, thereby preventing the folded flaps and the sidewalls from falling apart.

When the article needs to be removed from the main body 10, the cap is taken off and a portion of each of the sidewall adjacent the corresponding folded flap is pulled outwards. As a result, freeing the folded flaps so that the opening of the box would become larger than the bottom, thus removing the article is more convenient.

Figure 4:
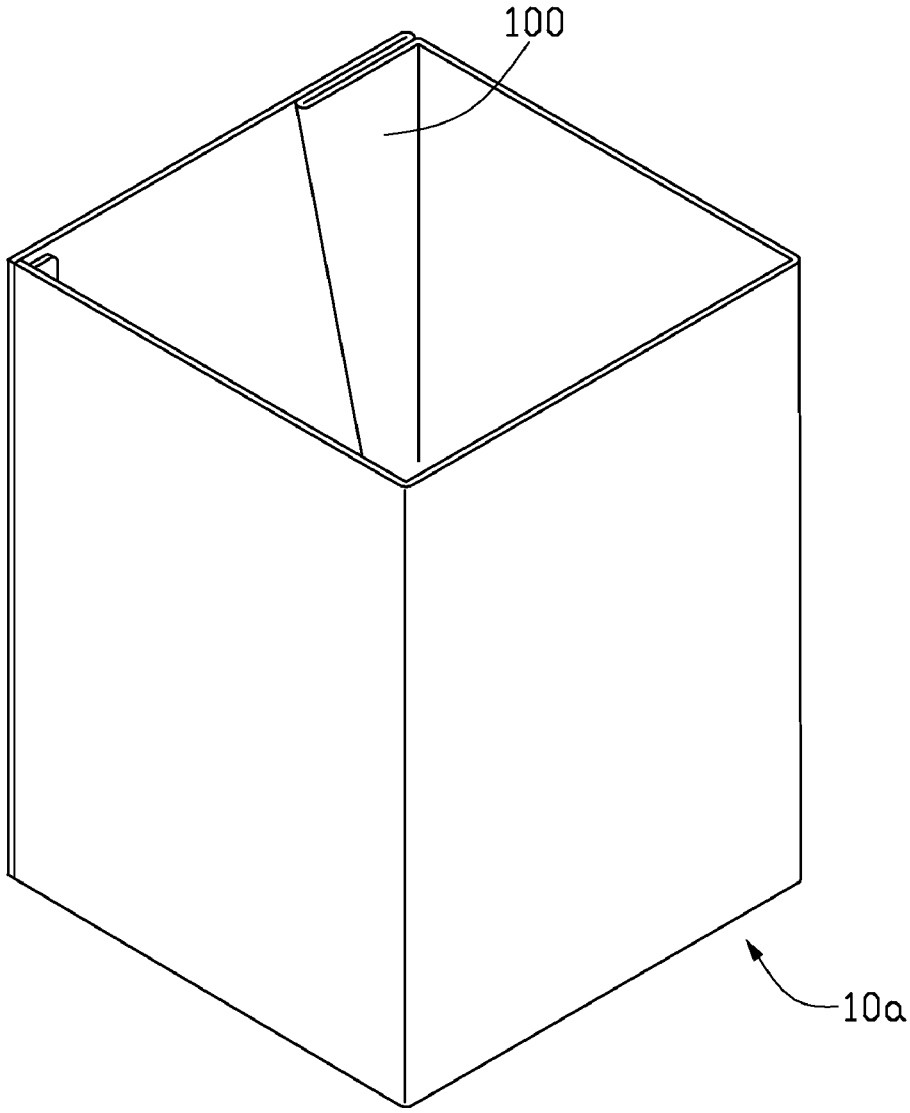
FIG. 4 is similar to FIG. 2, shown a container box according to a second embodiment.

Referring to FIG. 4, in a second embodiment, only one of the foldable flaps is provided. When the foldable flap 100 is inverted inwards into the main body 10*a*, the opening will become smaller. When the foldable flap 100 is pulled outwards, the opening will become larger.

Figure 5:
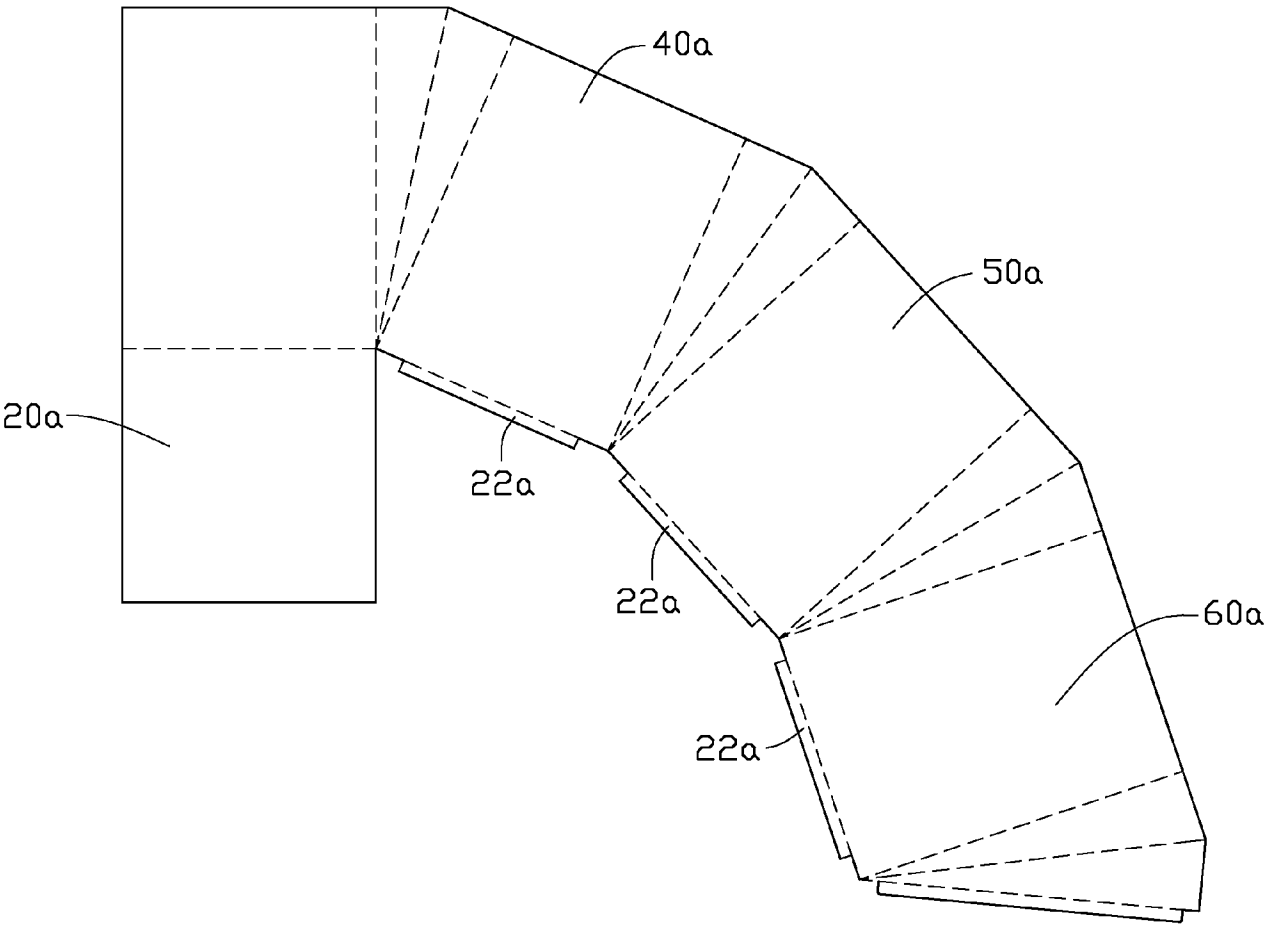
FIG. 5 is similar to FIG. 1, shown a container box expanded out according to a third embodiment.

Referring to FIG. 5, in a third embodiment, the three bottom flanges 22 of the first embodiment are not connected to the bottom panel 20, instead, three flanges 22*a* are connected to the corresponding lower edges of the second sidewall 40*a*, the third sidewall 50*a*, and the fourth sidewall 60*a* respectively. Each bottom flange 22*a* can be folded and attached to the corresponding edge of bottom panel 20*a*.

Figure 6:
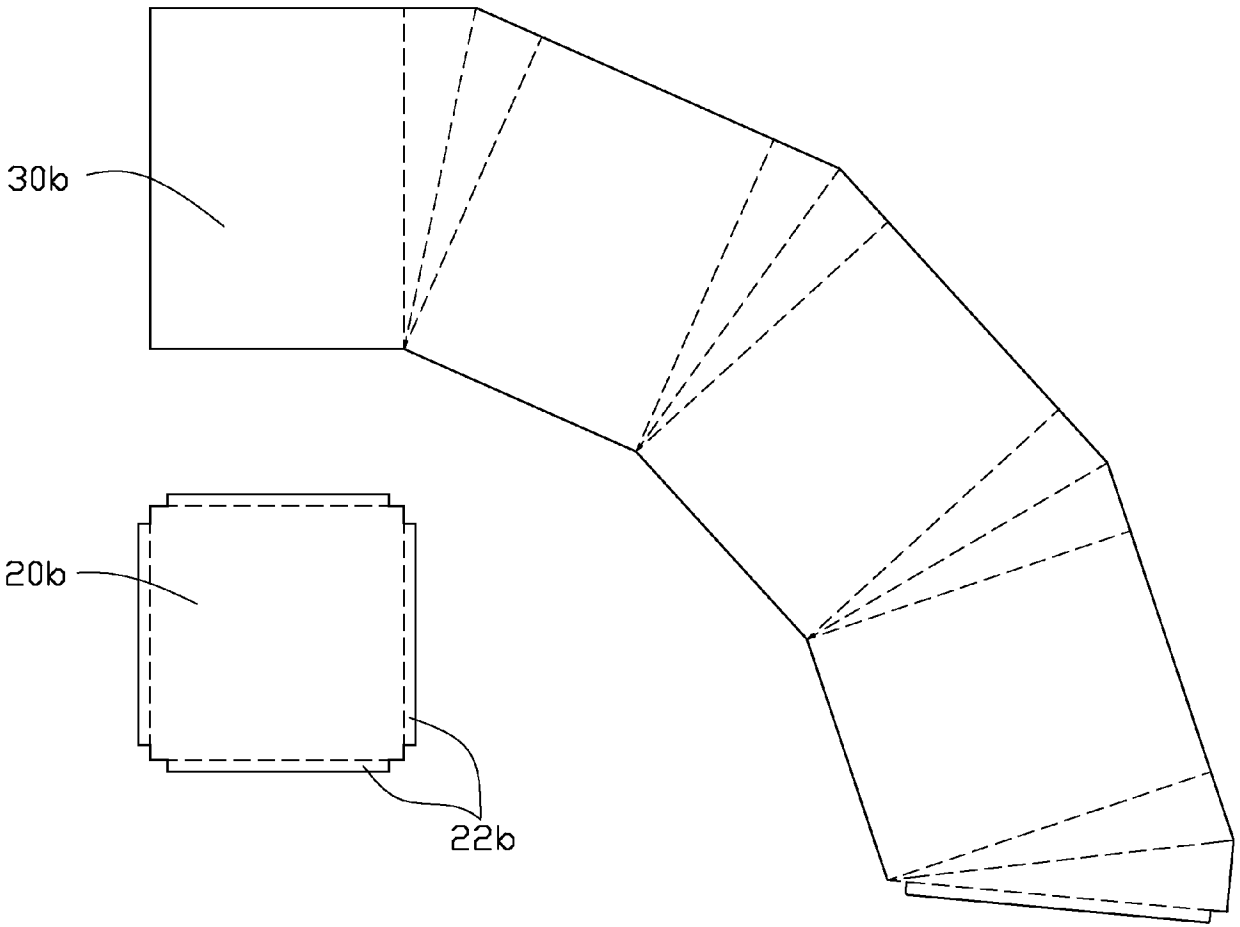
FIG. 6 is similar to FIG. 1, shown a container box expanded out according to a fourth embodiment.

Referring to FIG. 6, in a fourth embodiment, separate bottom panel 20*b* and side panel 30*b* are shown. Four bottom flanges 22*b* are connected to the four edges of the bottom panel 20*b*. Each bottom flange 22*b* can be folded and attached to the lower edge of the corresponding sidewall of the side panel 30*b*.

Figure 7:
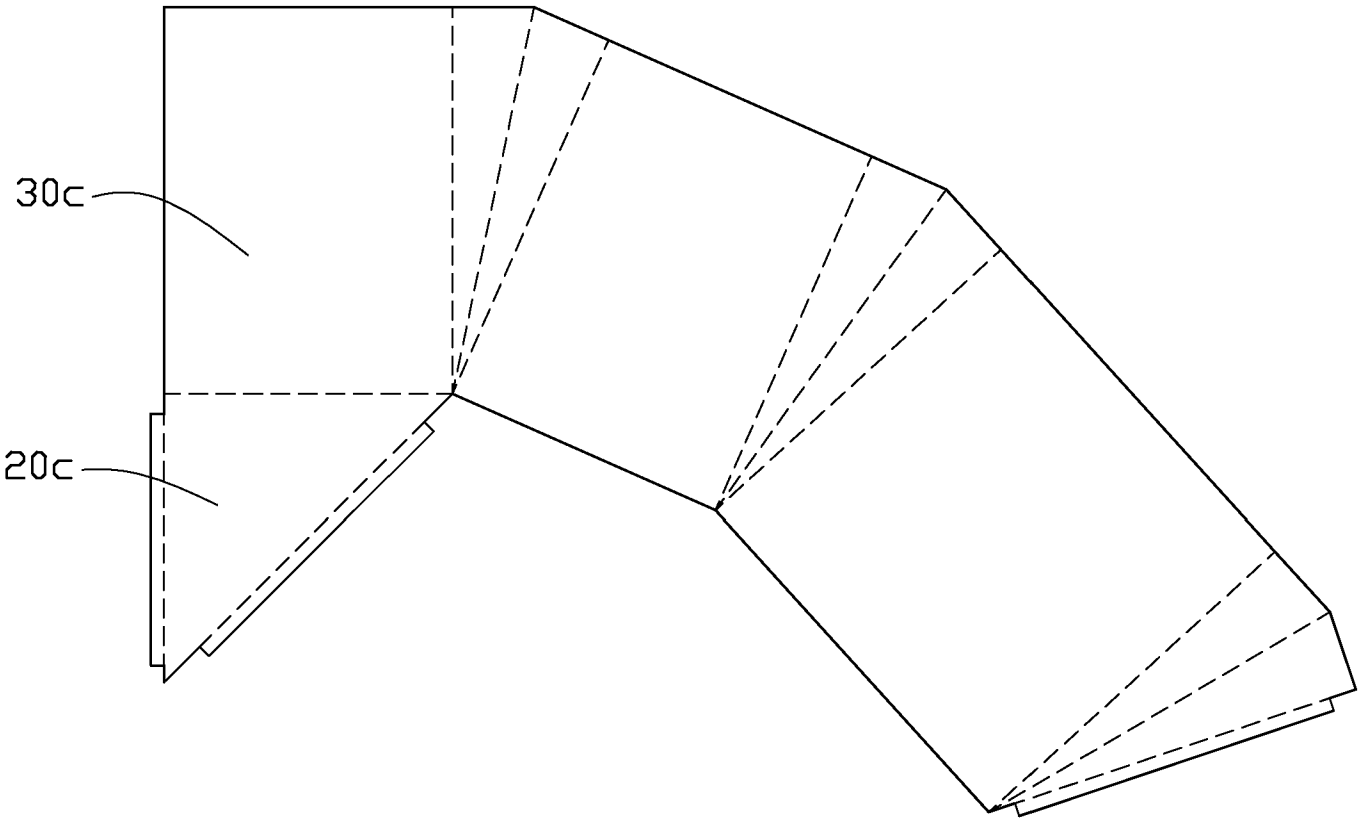
FIG. 7 is similar to FIG. 1, shown a container box expanded out according to a fifth embodiment.

In a fifth embodiment, the bottom panel 20 may not be square, it may be other polygonal. For example, referring to FIG. 7, a cardboard with a triangular bottom panel 20*c* is shown. Upon that condition, the sizes and numbers of the sidewalls are changed to fittingly engage with the bottom panel 20*c*.

Figure 8:
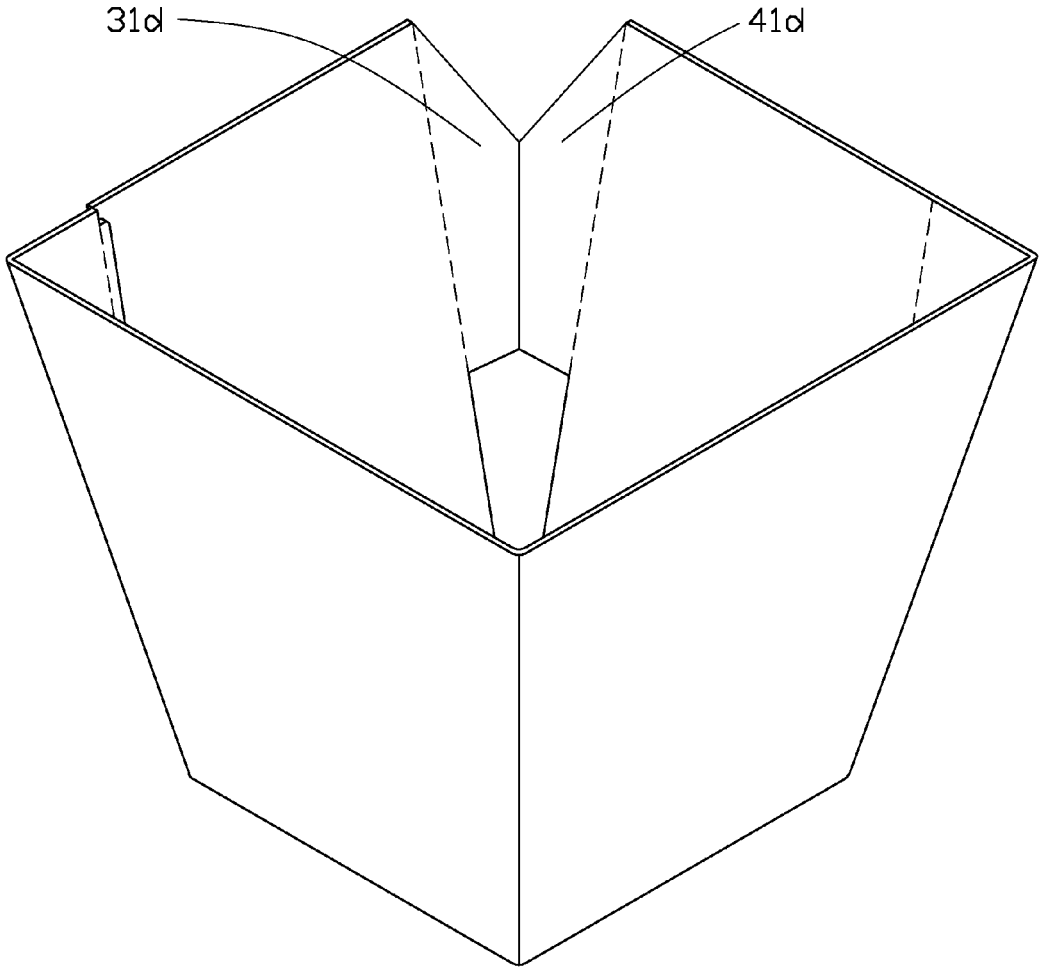
FIG. 8 is similar to FIG. 3, shown a container box according to a sixth embodiment.

Referring to FIG. 8, in a sixth embodiment, each foldable wall may not be triangular, it can be of other shapes, as foldable walls 31*d*, 41*d* shown in FIG. 8 for example.

While the embodiments have been disclosed with a cardboard material, it is understood that any suitable material can be used.

It is believed that the present embodiments and their advantages will be understood from the foregoing description, and it will be apparent that various changes may be made thereto without departing from the spirit and scope of the invention or sacrificing all of its material advantages, the examples hereinbefore described merely being embodiments of the invention.

What is claimed is:

1. A container box comprising:

a polygonal bottom panel comprising a plurality of edges;

a plurality of sidewalls connected to the edges of the polygonal bottom panel, wherein the bottom panel is a rectangular panel comprising four edges; the bottom panel comprises three bottom flanges extending from three of the four edges respectively; the number of sidewalls is four, and the sidewalls comprises a first sidewall, a second sidewall, a third sidewall, and a fourth sidewall; the first sidewall is connected to the other one of the edges of the bottom panel; and the bottom flanges are attached to the inside surfaces of the second sidewall, the third sidewall, and the fourth sidewall respectively; and a foldable flap joining two adjacent ones of the sidewalls; wherein the foldable flap is capable of being folded and expanded to change size of a receiving space cooperatively defined by the bottom panel, the sidewalls, and the foldable flap.

2. The container box as claimed in claim 1, wherein the foldable flap comprises a first and a second foldable wall, the first foldable wall is pivotally connected to the second foldable wall, and the first and second foldable walls are capable of creating space therebetween.

3. The container box as claimed in claim 2, wherein the foldable flap comprises a crease, and the first and second foldable walls are symmetric about the crease.

4. The container box as claimed in claim 3, wherein the first and second foldable walls are triangular.

5. The container box as claimed in claim 4, wherein the shapes of the first and second foldable walls are right triangles.

6. The container box as claimed in claim 5, wherein each of the first and second foldable walls comprises a hypotenuse edge, a longer edge, and a shorter edge;

the first and second foldable walls share the hypotenuse edge, the crease is defined along the hypotenuse edge;

each of the first and second foldable walls connects with the corresponding sidewall via the longer edge; and the shorter edge is aligned with the upper edge of the corresponding sidewall.

7. The container box as claimed in claim 1, wherein the foldable flap joins the first sidewall and the fourth sidewall;

one of the first and second foldable walls adjacent the first sidewall forms a side flange; and the side flange is attached to the inside surface of the first sidewall.

8. An apparatus comprising a container, the container comprising:

a polygonal bottom panel comprising N sides;

N sidewalls, wherein N equals 4, the bottom panel comprises three bottom flanges extending from three of the sides respectively; and the sidewalls comprises a first sidewall, a second sidewall, a third sidewall, and a fourth sidewall; the first sidewall is connected to the other one of the sides of the bottom panel; and the bottom flanges are attached to the inner surfaces of the second sidewall, the third sidewall, and the fourth sidewall respectively; and N flaps, each flap located between two adjacent sidewalls; wherein the flaps are capable of unfolding to increase the volume of the container.

9. The apparatus as claimed in claim 8, wherein each of the flaps comprises a first and a second foldable wall, the first foldable wall is pivotally connected to the second foldable wall, and the first and second foldable walls are capable of creating space therebetween.

10. The apparatus as claimed in claim 9, wherein each of the flaps comprises a crease, and the first and second foldable walls are symmetric about the crease.

11. The apparatus as claimed in claim 10, wherein the first and second foldable walls are triangular.

12. The apparatus as claimed in claim 11, wherein the shapes of the first and second foldable walls are right triangles.

13. The apparatus as claimed in claim 12, wherein each of the first and second foldable walls comprises a hypotenuse edge, a longer edge, and a shorter edge;

the first and second foldable walls of each of the flaps share the corresponding hypotenuse edge, each of the creases is defined along the corresponding hypotenuse edge;

each of the first and second foldable walls connects with the corresponding sidewall via the longer edge; and each of the shorter edges is aligned with the upper edge of the corresponding sidewall.

14. The apparatus as claimed in claim 8, wherein one of the first and second foldable walls adjacent the first sidewall forms a side flange; and the side flange is attached to the inside surface of the first sidewall.

15. A container box comprising:

a polygonal bottom panel comprising a plurality of edges;

a plurality of sidewalls, a first one of the sidewalls having a bottom edge connected to one of the edges of the bottom panel, the other sidewalls extending in sequence from a side edge of the first one, bottom edges of the other sidewalls angled from each other and separated from the bottom panel;

a plurality of flanges extending from the edges of the bottom panel or the bottom edges of the other sidewalls; and at least one foldable flap joining two adjacent sidewalls; wherein the flanges are attached to inner surfaces of the other sidewalls or the bottom panel, such that the bottom panel, the sidewalls, and the foldable flap cooperatively bound a receiving space, and the at least one foldable flap is capable of being folded and expanded to change size of the receiving space.

16. The container box of claim 15, wherein the bottom edge of the first sidewall is integrally formed from said one of the edges of the bottom panel.

17. The container box of claim 15, wherein the at least one foldable flap comprises a first foldable wall, a crease, and a second foldable wall, the first and second foldable walls are symmetric about the crease, and can be folded along the crease, with creating space therebetween.

18. The container box of claim 17, wherein the shapes of the first and second foldable walls are right triangles, each of the first and second foldable walls comprises a hypotenuse edge, a first edge, and a second edge; each of the first and second foldable walls share the hypotenuse edge, the crease is formed along the hypotenuse edge; each of the first and second foldable walls connects the corresponding sidewall with the first edge; and the second edge is aligned with an upper edge of the corresponding sidewall.

19. The container box of claim 15, wherein the bottom panel is a rectangular panel comprising four edges; the bottom panel comprises the flanges extending from three of the four edges respectively; the number of sidewalls is four, and the sidewalls comprises a first sidewall, a second sidewall, a third sidewall, and a fourth sidewall; the first sidewall is connected to the other one of the four edges of the bottom panel; and the flanges are attached to the inner surfaces of the second sidewall, the third sidewall, and the fourth sidewall, respectively.

20. The container box of claim 15, wherein the bottom panel is a triangular panel comprising three edges; the bottom panel comprises the flanges extending from two of the three edges respectively; the number of sidewalls is three, and the sidewalls comprises a first sidewall, a second sidewall, and a third sidewall; the first sidewall is connected to the other one of the three edges of the bottom panel; and the flanges are attached to the inner surfaces of the second sidewall, and the third sidewall, respectively.

* * * * *